United States Patent [19]

Freedman

[11] 4,042,308

[45] Aug. 16, 1977

[54] MODULAR ROADWAY FOR A TRANSPORTATION SYSTEM

[75] Inventor: Mark Freedman, Cinnaminson, N.J.

[73] Assignee: Westinghouse Electric Corporation, Pittsburgh, Pa.

[21] Appl. No.: 658,947

[22] Filed: Feb. 18, 1976

[51] Int. Cl.[2] ..... E01C 1/00

[52] U.S. Cl. ..... 404/1; 14/1; 52/174

[58] Field of Search ..... 404/1; 14/1; 52/174, 52/87

[56] References Cited

U.S. PATENT DOCUMENTS

| | | | |
|---|---|---|---|
| 2,192,269 | 3/1940 | Maddock | 14/16 J |
| 2,225,186 | 12/1940 | Sorensen | 404/1 |
| 2,287,210 | 6/1942 | Wellborn | 52/174 |
| 3,365,895 | 1/1968 | Jacobs | 404/1 X |
| 3,477,080 | 11/1969 | Finsterwalder | 404/1 X |
| 3,540,068 | 11/1970 | Bouthors | 404/1 X |
| 3,630,153 | 12/1971 | Guimarin | 404/1 X |
| 3,794,433 | 2/1974 | Schupack | 404/1 |
| Re. 8,860 | 8/1879 | Williams | 404/1 |

*Primary Examiner*—Nile C. Byers
*Attorney, Agent, or Firm*—R. G. Brodahl

[57] ABSTRACT

There is disclosed an aerial roadway comprised of prefabricated, cantilevered deck modules; and supporting columns, interlockingly mounted on and monolithically attached to prefabricated, prestressed, post-tensioned spinal beams supported on columns; an elevated roadway comprised of prefabricated cantilevered deck modules monolithically attached to a supporting wall; and a grade-level roadway comprised of deck modules monolithically attached to a foundation located at grade level. The deck modules are provided with integral layers of porous, bituminous paving material which provide a continuous, smooth, water-permeable running surface. Vehicles are directed along the aerial elevated and ground-level roadways by guide wheels depending from the vehicles and impinging on the guide beam fixed to the deck modules. A modification of the cantilevered deck modules provides aerial, elevated and ground-level roadways for transportation systems employing relatively small, light vehicles.

10 Claims, 8 Drawing Figures

MODULAR ROADWAY FOR A TRANSPORTATION SYSTEM

BACKGROUND OF THE INVENTION

1. Field of the Invention

The invention relates to a roadway suitable for use in a transportation system and a method for constructing the roadway.

2. Description of the Prior Art

Prior art transportation systems which employed self-propelled, rubber-tired vehicles, such as seen in U.S. Pat. No. 3,312,180 of E. O Mueller, included aerial and elevated roadways as well as ground-level roadways. An article entitled The Transit Expressway, published by C. Kerr in the January 1963 Westinghouse Engineer at pages 2 to 7, describes such a system. Aerial roadways, supported by columns, were designed to avoid natural and man-made obstacles such as rivers and conventional highways, to provide for cross-overs in the roadway, and to permit horizontal access to buildings at a point significantly above ground level. Elevated roadways, supported at moderate heights by continuous wall structures, were designed for environments subject to flooding or for grade separation of a roadway built over an existing highway. These prior art aerial, elevated, and ground-level roadways consisted of steel and concrete and their construction included the process of pouring concrete into wooden forms which were assembled at the construction site. A typical structure for these roadways and a method for their construction is described in "Transit Expressway Report" and "Transit Expressway Report Phase II" prepared by the MPC Corporation, 4400 5th Avenue, Pittsburgh, Pa. Substantial periods of time were required to construct the forms, pour the concrete, and dismantle the forms after the concrete had dried. This resulted is substantial delay and consequent higher costs in the construction of transportation system. Therefore, there was a need for a roadway which could be constructed quickly and economically.

SUMMARY OF THE INVENTION

Aerial, elevated and ground-level roadways are provided for transportation systems having vehicles directed along a roadway by guide wheels which depend from the vehicle and cooperate with a guide beam associated with the roadway. The aerial roadway is comprised of precast, cantilevered deck modules which are monolithically mounted on precast, prestressed, post-tensioned, spinal beams elevated by supporting columns. The elevated roadway is comprised of precast, cantilevered deck modules monolithically attached to a supporting concrete wall. The grade-level roadway is comprised of cantilevered deck modules monolithically attached to a grade-level foundation. In the aerial, elevated and ground-level roadways, the cantilevered deck modules are interlocked and include layers of porous, bituminous paving material which provide a smooth, continous roadway surface resistant to the accumulation of water. Flanges operative with threaded dowels secure the vehicle guide beam to the roadway deck modules. A modification of the cantilevered deck modules provides aerial, elevated and ground-level roadways for transportation system employing relatively small, light vehicles.

DESCRIPTION OF THE PREFERRED EMBODIMENT

Figure 1:
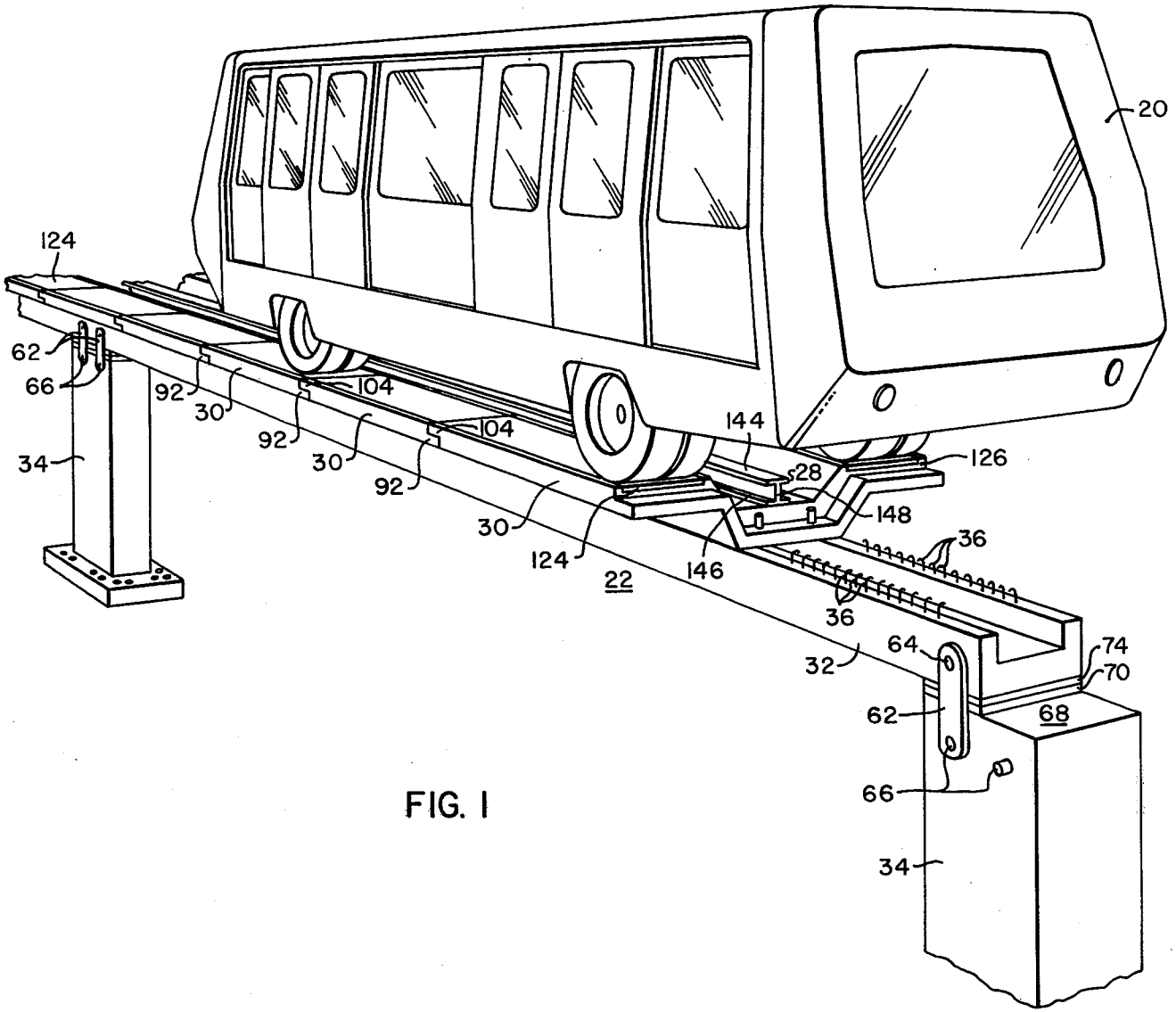
FIG. 1 is an isometric view of a transportation vehicle traveling the disclosed aerial roadway with a portion of the roadway broken away to show its structure.

FIG. 1 shows a transportation system in which a transportion vehicle 20 is directed along an aerial roadway 22 by guide wheels 24 and 26 (shown in FIG. 5) depending from vehicle 20 and impinging on a guide beam 28. The aerial roadway 22 is comprised of cantilevered deck modules 30 secured in successive relation to a spinal beam 32 which is elevated from grade level by supporting columns 34. One of the deck modules 30 has been removed to reveal the hooked dowels 36 used in securing the deck modules 30 to the spinal beam 32.

Figure 2:
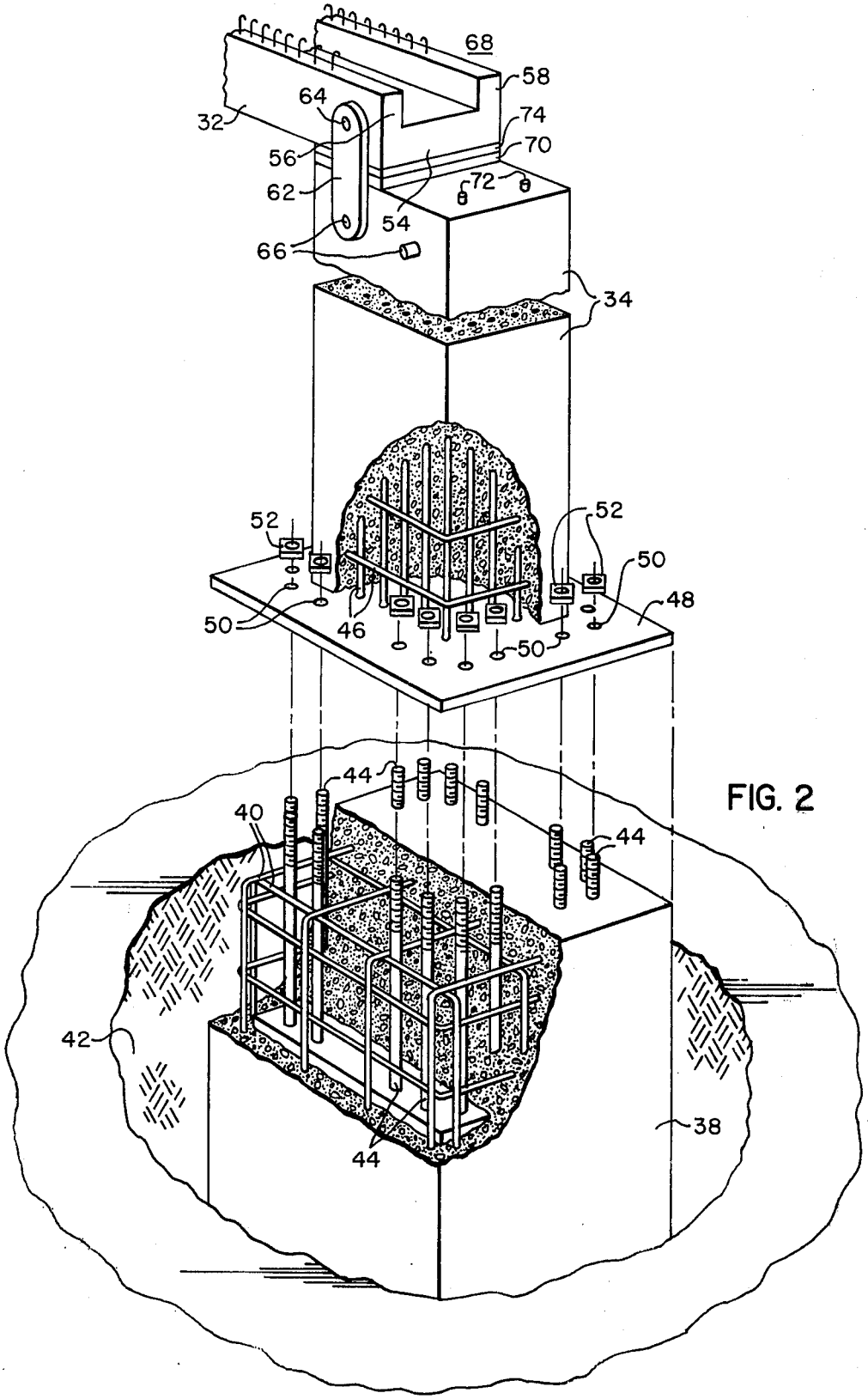
FIG. 2 is an isometric assembly drawing of the supporting column of the aerial roadway.
Figure 3:
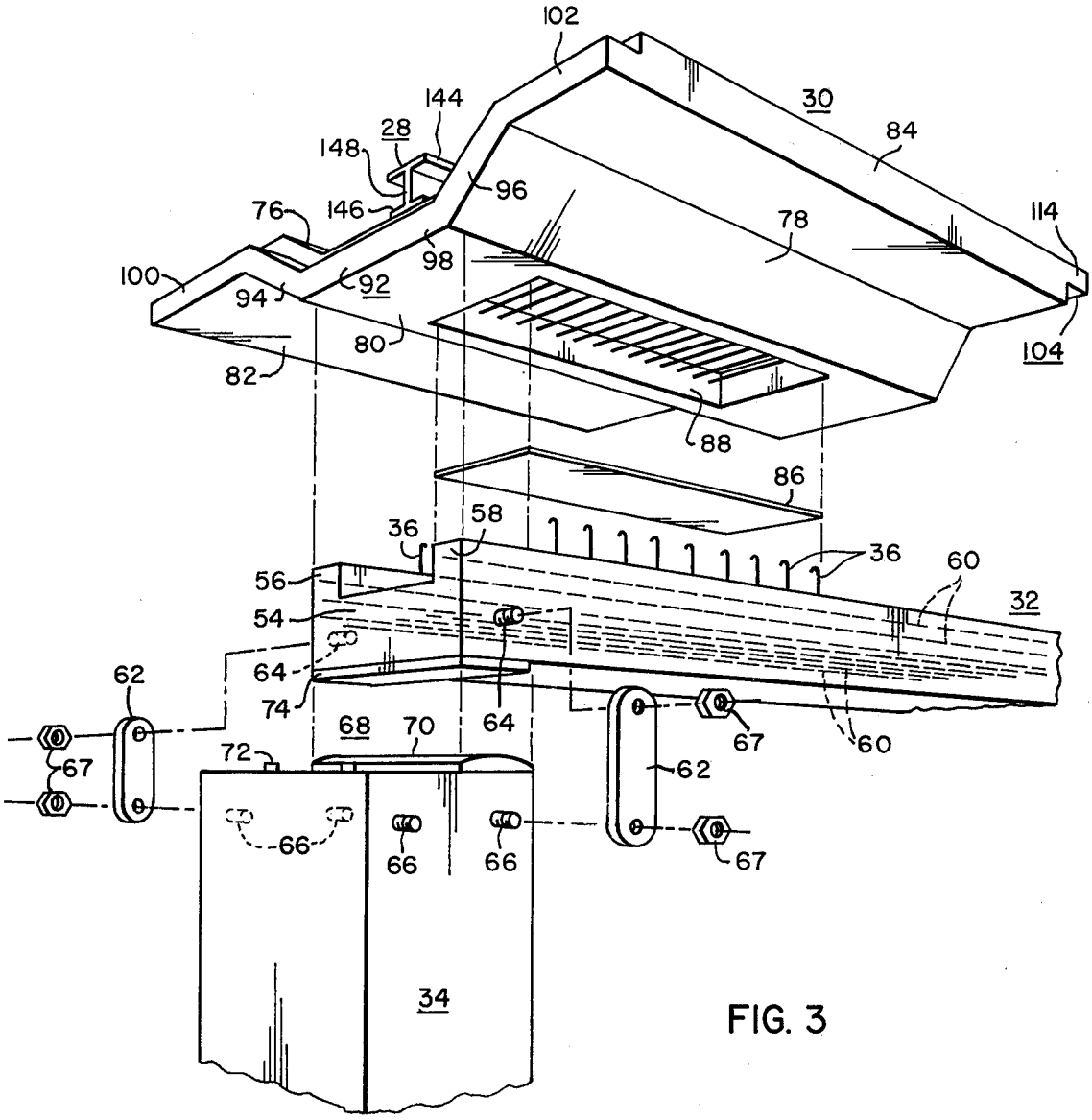
FIG. 3 is a isometric assembly drawing of the spinal beam and deck module for the aerial roadway.
Figure 4:
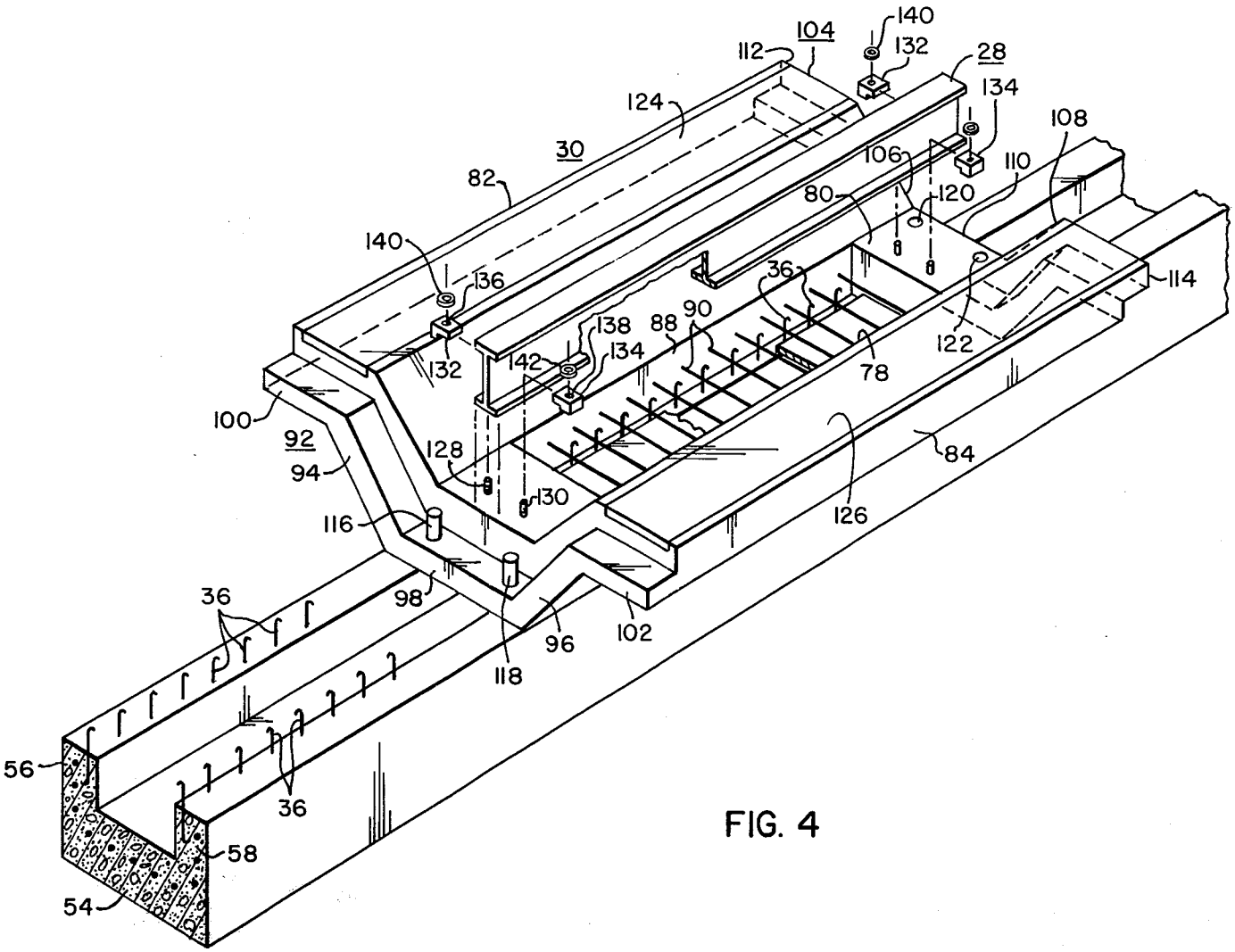
FIG. 4 is an isometric view of a deck module and a spinal beam showing the structure for monolitchically attaching the deck module to the spinal beam.

The detailed structure and assembly of aerial roadway 22 is here explained in relation to FIGS. 2, 3 and 4. In FIG. 2, column 34 is supported on pedestal base 38 which is constructed by placing the reinforcing bar cage 40 in an excavation 42. Anchor bolts 44 are arranged and secured in reinforcing bar cage 40 over which concrete is then poured. Although the pedestal base 38 could be precast and then shipped to the roadway site for installation, it will generally not be economically practical to do so because the size of the pedestal base will depend on the load which the base must support and geological properties of the ground at the point where the base is located.

The supporting column 34 which is mounted on pedestal base 38 is comprised of precast, reinforced concrete. Supporting column 34 is preformed at a location remote from the roadway construction site by pouring concrete over a reinforcing bar cage 46 which has been welded to a masonry plate 48. Masonry plate 48 is provided with holes 50 whole orientation corresponds to the position of the anchor bolts 44. After the concrete has hardened, supporting column 34 is shipped to the roadway construction site and lowered onto pedestal base 38 so that anchor bolts 44 pass through the holes 50 in masonry plate 48. Supporting column 34 is then fastened to pedestal base 38 by turning nuts 52 onto anchor bolts 44.

As shown in FIG. 1, the spinal beams 32 are supported in end-to-end relation at a predetermined elevation by locating a supporting column 34 under both ends of each individual spinal beam 32. The spinal beams 32 are comprised of prestressed, reinforced concrete which, like the supporting column 34 is precast and transported to the construction site where it is incorporated into the roadway structure. As shown in FIG. 3, spinal beam 32 has a base 54, sides 56 and 58, and contains prestressing tendons 60 eccentrically located about its longitudinal axis. The spinal beam 32 is coupled to supporting column 34 by torsion links 62. Torsion links 62 are coupled to spinal beam 32 by cast-in, torsion link connectors 64 and coupled to supporting column 34 by cast-in torsion link connectors 66. Torsion links 62 are maintained on torsion link connectors 64 and 66 by torsion link connector caps 67. An expansion bearing 68 includes a lower bearing surface 70 fastened to supporting column 34 by cast-in, expansion bearing connectors 72 and an upper bearing surface 74 fastened to spinal beam 32 by cast-in expansion bearing connectors (not shown) substantially similar to expansion bearing connectors 72. Expansion bearing 68, which could be made of steel, reinforced rubber or suitably similar material, provides a bearing surface between spinal beam 32 and supporting column 34 to permit longitudinal expansion of the spinal beam 32 while resisting vertical and tortional forces exerted on the spinal beam. These vertical and torsional forces may for example, be due to wind or movements of the vehicle 20.

After the precast, prestressed spinal beams are mounted on columns 32, the simply supported spinal beams are post-tensioned so that a given structural strength may be achieved by using smaller, lighter spinal beams than otherwise would be required. As will be recognized by those skilled in the art, additional economics in the size and strength of spinal beams may be realized by post-tensioning the spinal beams into continuous member so that the forces exerted on a particular spinal beam are distributed among the spinal beams with which it is post-tensioned. By way of example, if the spinal beams are post-tensioned in groups of three, the lateral forces exerted on one spinal beam from wind, and the vertical and torsional forces exerted on the spinal beam from a vehicle, would be distributed among three spinal beams.

As shown in FIGS. 3 and 4, cantilevered deck module 30 is comprised of a single piece of reinforced concrete and includes arms 76 and 78, web 80, and wings 82 and 84. Deck module 30 is designed to carry the weight of vehicle 20 on its cantilevered arms 76 and 78. Since maximum bending moment in the deck module is produced at the junction between web 80 and arms 76 and 78, the width of inclined arms 76 and 78 is tapered so that they are thicker at this point. Like supporting column 34 and spinal beam 32, cantilevered deck module 30 is prefabricated at a remote location and then shipped to the roadway construction site where it is monolithically attached to spinal beam 32.

Cantilevered deck module is monolithically attached to spinal beam 32 with the use of form sheet 86. Form sheet 86, which may be comprised of steel, is slightly wider than the channel formed between the sides 56 and 58 of spinal beam 32 so that the form sheet 86 will span the channel but will lie between the hooked dowels 36 cast into the top of the sides 56 and 58 of spinal beam 32. Form sheet 86 is placed over the channel formed between sides 56 and 58 of spinal beam 32 and deck module 30, which has a cavity 88 in web 80 which exposes transverse reinforcing rods 90, is placed on spinal beam 32 such that hooked dowels 36 pass between transverse reinforcing rods 90 and the bottom of the cavity 88 in web 80 of deck module 30 is covered by form sheet 86 cooperating with the upper horizontal surface of sides 56 and 58 of spinal beam 32. The cavity 88 in web 80 of deck module 30 is then filled with concrete so that, after the concrete has hardened, cantilevered deck module 30 is monolithically attached to spinal beam 32. The cavity 88 in the web 80 of deck module 30 is shown more clearly in the FIG. 4 isometric view of the deck module 30 and spinal beam 32.

FIGS. 3 and 4 also illustrate a structure for interlocking adjacent deck modules 30 fixed to spinal beam 32. The forward end of a first deck module 30 is provided with a lower flange 92 comprising arms 94 and 96, web 98 and wings 100 and 102. The far end of the first deck module 30 is provided with an upper flange 104 comprising arms 106 and 108, web 110 and wings 112 and 114. Lower flange 92 is provided with guide pins 116 and 118 and upper flange 104 is provided with guide holes 120 and 122. When a second deck module, substantially identical to the first deck module is placed in front of the first deck module so that guide pin 116 and 118 of the first deck module penetrate guide holes 120 and 122, the upper flange 104 of the second guide deck module cooperates with the lower flange 92 of the first deck module to provide an interlocking junction between the first and second deck modules. Therefore, cantilevered deck modules may be successively placed in longitudinal relation along spinal beam 32 as they are monolithically attached to spinal beam 32 to provide a roadway surface for vehicle 20. A side view of the junction between lower flange 92 and upper flange 104 which interlocks adjacent deck modules 30 is shown in FIG. 1.

Figure 5:
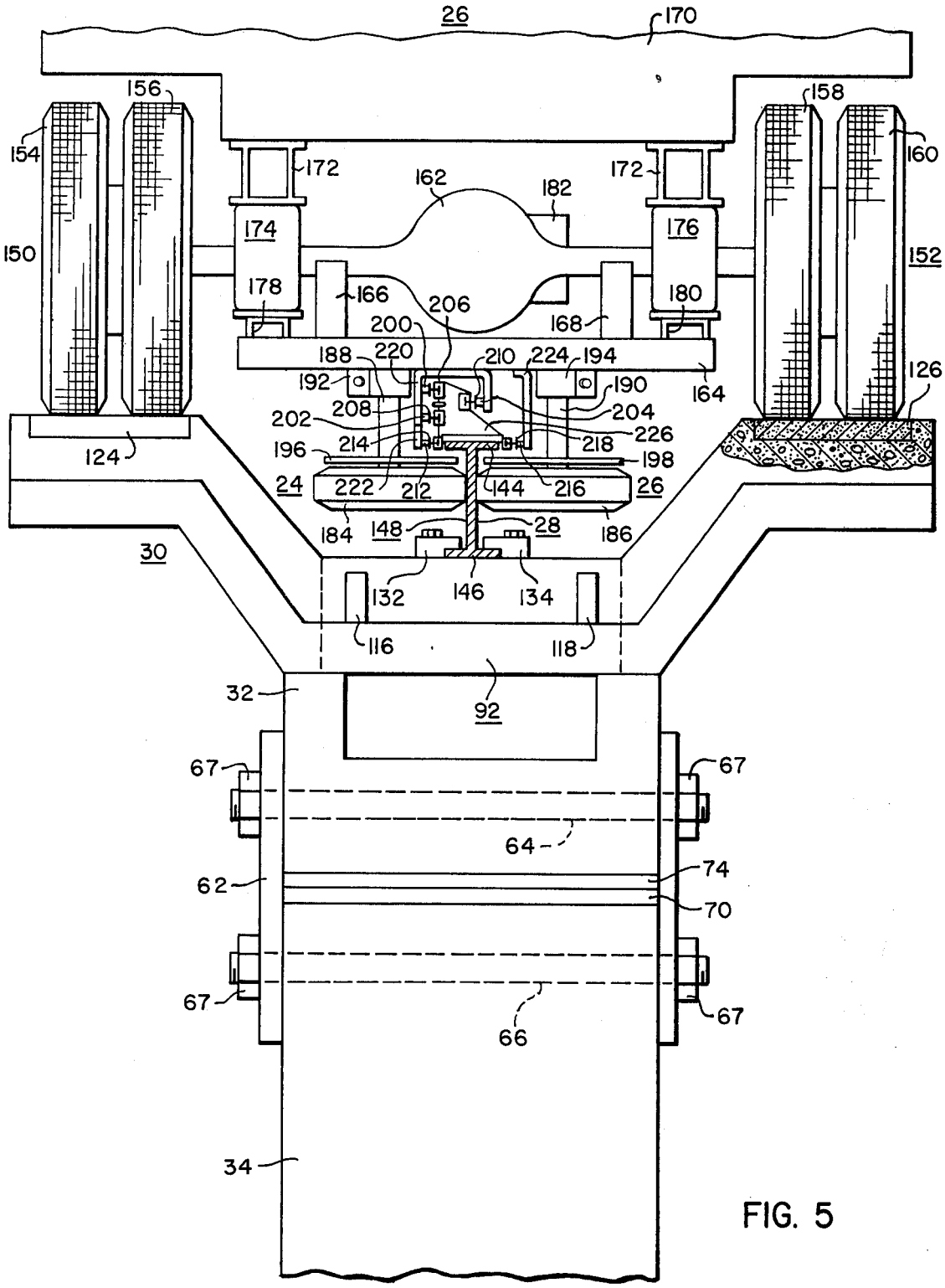
FIG. 5 is a cross-sectional view of the aerial roadway showing the means for guiding a vehicle along the roadway.

FIGS. 4 and 5 show porous bituminous running surfaces 134 and 126 provided in channels in wings 82 and 84 of deck module 30. The porous running surfaces 124 and 126 are laid after the deck modules have been monolithically attached to spinal beam 32 to provide a continuous roadway surface which eliminates noise and vibration in vehicle 20 caused by small gaps or misalignment at the junctions between deck modules. Porous running surfaces 124 and 126 are comprised of a water permeable material which prevents the accumulation of surface water and reduces the potential for wet or icy roadways which may cause hydroplaning or skidding of vehicle 20.

As shown in FIG. 4, deck module 30 is also provided with cast-in, threaded dowels 128 and 130 which are cast into web 80 and which cooperate with flanges 132 and 134, having aperatures 136 and 138 and nuts 140 and 142, to secure guide beam 28, shown in FIGS. 1, 3 and 5 to deck module 30. Flanged guide beam 28 is comprised of upper and lower horizontal flanges 144 and 146 joined by vertical web 148. After guide beam 28 is placed between threaded dowels 128 and 130, flanges 132 and 134 are placed over threaded dowels 128 and 130 so that threaded dowels 128 and 130 are contained in the apertures 136 and 138 of flanges 132 and 134 respectively. Nuts 140 and 142 are then turned down on threaded dowels 128 and 130 causing flanges 132 and 134 to impinge on the lower flange 146 of guide beam 28 thereby securing the guide beam 28 to deck module 30. Guide beam 28 is secured in substantially the same manner by additional threaded dowels and flanges located at longitudinal intervals along the guide beam 28.

As explained in relation to FIGS. 3 and 4 of the aerial roadway, web 80 of deck module 30 is integrally attached to spinal beam 32. Web 80 of deck module 30 therefore cooperates with spinal beam 32 to form a prismatic member which provides the supportive strength of the aerial roadway. The shape of the deck module 30 and the spinal beam 32 was selected so that the prismatic member would provide a predetermined moment of inertia. Specifically, the shape formed by the cross-section of web 80 and spinal beam 32 provides a sufficient moment of inertia for supporting the live weight of the vehicle 20, the dead weight of deck module 30, the dead weight of the spinal beam 32, and lateral forces, such as caused by wind.

FIG. 5 is a cross-sectional view of aerial roadway 22 taken along the roadway's longitudinal axis and showing transportation vehicle 20 having a pair of resilient, laterally spaced main wheels 150 and 152 running on porous surfaces 124 and 126 contained in channels in wings 82 and 84. Main wheel 150 is comprised of tires 154 and 156 and main wheel 152 is comprised of tires 158 and 160. The vehicle 20 is provided with at least two such pairs of resilient, laterally spaced, main wheels fixed longitudinally along the vehicle. The wheel pair 150, 152 shown in FIG. 5 is connected by an axle (not shown) contained in an axle housing 162 which is fixed to the vehicle frame 164 by support brackets 166 and 168. The vehicle 20 also includes a body 170 mounted on a longitudinal frame 172 resiliently supported by air springs 174 and 176 mounted on channel members 178 and 180 mounted on vehicle frame 164. The vehicle is powered by an electric motor 182 coupled to the axle connecting wheels 150 and 152.

The vehicle steering mechanism includes sets of opposing guide wheels which follow opposite sides of guide beam web 148. FIG. 5 illustrates one such set of guide wheels 26 and 24, comprised of pneumatic, resilient guide tires 184 and 186, carried on vertical axles 188 and 190, which are clamped to vehicle frame 164 by split bushings 192 and 194. The ends of vertical axles 188 and 190 are clamped in a position which produces a predetermined force between the guide beam web 148 and pneumatic guide tires 184 and 186. Due to the resiliency of pneumatic tires 184 and 186, the normal operating distance between the surface of guide beam web 148 and the centerline of vertical axles 188 and 190 in somewhat less than the true radius of pneumatic tires 184 and 186. This distance will be referred to as the "operating radius ". Excessive deviations in the operating radius due to unusual lateral forces acting on the transportation vehicle 20 or due to under-inflation of pneumatic tires 184 or 186, are limited by steel safety discs 196 and 198 attached to vertical axles 188 and 190, respectively. The radius of each safety disc is slightly less than the operating radius of its associated pneumatic guide tire so that if pneumatic tire 184 and 186 becomes deflated or the vehicle experiences abnormally strong, lateral wind or centrifugal forces, the associated safety disc 196 or 198 will engage the web 148 of the guide beam 28 and assume steering control of the vehicle. The safety discs 196 and 198 serve a second function by cooperating with the upper flange 144 by guide beam 28 to oppose forces tending to cause the vehicle to roll.

Apparatus for supplying electric power and control signals to the vehicle includes power collectors 200, 202 and 204 in contact with power rails 206, 208 and 210, respectively; ground collector 212 in contact with ground rail 214; and control signal collector 216 in contact with control signal rail 218. Power collectors 200, 202 and 204 are carried by bracket 220 fixed to vehicle frame 164. Ground collector 212 is mounted in bracket 222 and control signal collector 216 is mounted in bracket 224 which are similarly fixed to vehicle frame 164. Power rails 206, 208 and 210; ground rail 214; and control signal rail 218 are insulatively supported by mounting brackets 226 attached at longitudinal intervals to the upper flange 144 of guide beam 28.

Figure 6:
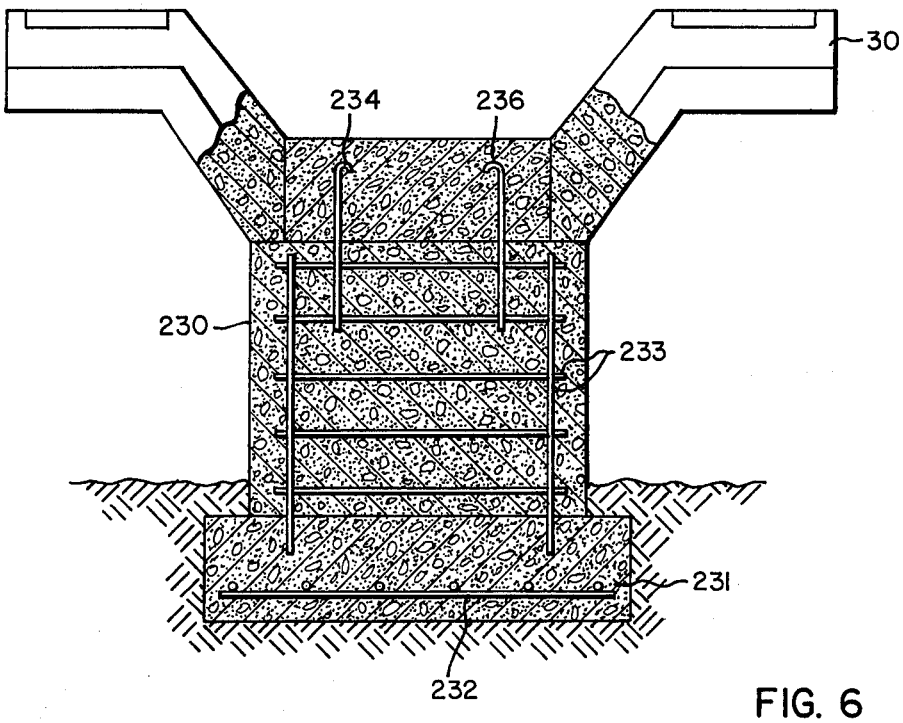
FIG. 6 is a cross-sectional view of an elevated roadway supported by a wall.

FIG. 6 is a cross-sectional view, perpendicular to the longitudinal axis of an elevated roadway 228 in which deck modules 30 are employed to provide a roadway surface which is maintained at intermediate elevations. In the elevated roadway 228, deck modules 30 are monolithically attached to a reinforced concrete wall 230 which is supported by a foundation 231 located below ground level. Foundation 231 is formed by pouring concrete over a reinforcing bar screen 232 placed in an excavation. Wall 230 is formed by pouring concrete over a reinforcing bar cage 233 which is partly cast-in foundation 231 and framed in a wooden form. Wall 230 and foundation 231 are therefore fixed together by bar cage 233 which is cast-in both the wall and the foundation. Hooked dowels 234 and 236 are cast at longitudinal intervals in the upper horizontal surface of wall 228. Using the same basic technique as previously described in relation to aerial roadway 22, deck module 30 is placed on concrete wall 230 such that hooked dowels 234 and 236 extend between transverse reinforcing rods 90 of deck module 30. Deck module 30 is then monolithically attached to wall 230 by filling the cavity of deck module 30 with concrete. Since the top surface of wall 230 covers the bottom of the cavity 88 in the web 80 of deck module 30, the use of form sheet 86 is not required. However, if a conduit between concrete wall 230 and deck module 30 was desired as, for example, a convenient way to carry power cables, such a conduit could be provided by forming a channel in the upper surface of wall 230 similar to the channel in spinal beam 32, and covering the bottom of cavity 88 with form sheet 88 in the same manner as described in relation to aerial roadway 22.

Figure 7:
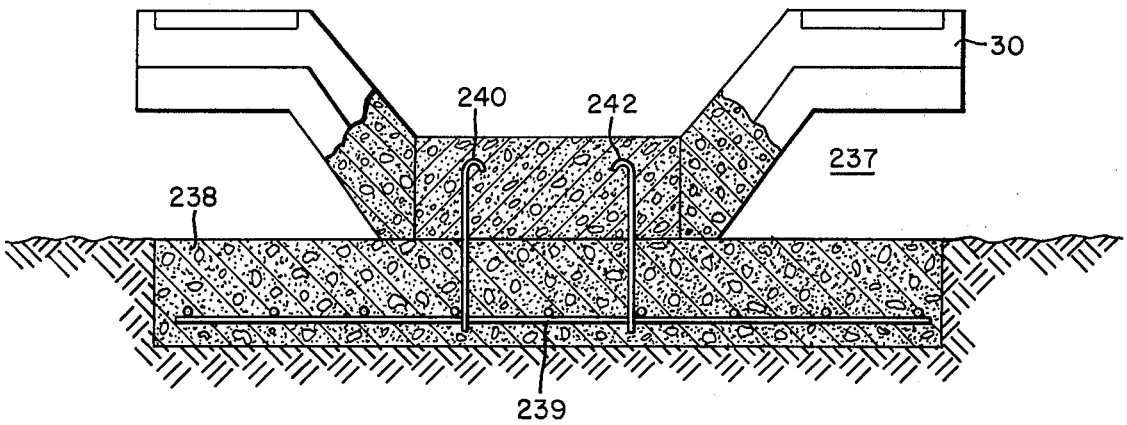
FIG. 7 is a cross-sectional view of a ground-level roadway supported by a ground-level foundation.

FIG. 7 is a cross-sectional view, perpendicular to the longitudinal axis of a ground-level roadway 237 in which deck module 30 is used to provide a roadway surface located near ground level. Deck modules 30 are supported by a ground-level foundation 238 which is formed by pouring concrete over reinforcing bar screen 239. Hooked dowels 240 and 242 are cast-in foundation 238 and deck modules 30 are monolithically attached to foundation 238 in the same manner as described in relation to the elevated roadway 228 of FIG. 6. Deck module 30 is placed on foundation 238 so that hook dowels 240 and 242 extend between transverse reinforcing rods 90 and the cavity 88 in deck module 30 is filled with concrete. In a manner similar to elevated roadway 228, the bottom of cavity 99 in the web 80 of deck module 30 is covered by foundation 238 without using form sheet 86. However, if a conduit between foundation 238 and deck module 30 is desired, a channel may be provided in the top surface of foundation 238 between hooked dowels 240 and 242 and the bottom of cavity 88 covered with form sheet 86 before the deck module is monolithically attached.

Figure 8:
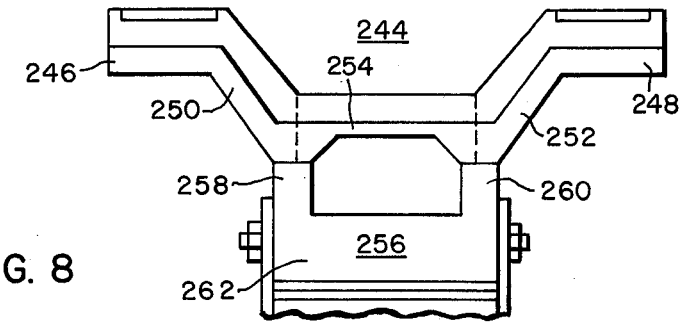
FIG. 8 is a cross-sectional view of a modified deck module suitable for supporting relatively small light vehicles.

FIG. 8 shows a modification of deck module 30 and spinal beam 32 which may be used in transportation system employing smaller vehicles to decrease the amount of building material required to construct the roadway. The deck module 244 of FIG. 8 is comprised of wings 246 and 248 supported by arms 250 and 252 which are joined by web 254. The bottom of web 254 forms a trapezoidal channel so that web 254 of deck module 244 is thinner and requires less concrete for its precast construction and monolithic attachment then does web 80 of deck module 30. The spinal beam 25 of FIG. 8 is comprised of sides 258 and 260 which are joined by base 262. Base 262 of spinal beam 256 is thinner than the base 54 of spinal beam 32 to reduce the concrete necessary for the construction of spinal beam 256. Even with these reduction in size, deck module 244 and beam 256 provide a moment of inertia strong enough to support the typical, lighter transportation vehicles. For example, while deck module 30 is suited for supporting a vehicle having a wheel base 80 inches and weighing 26,500 pounds, the deck module 244 and spinal beam 256 of FIG. 8 would be suitable for a vehicle having a wheel base of 73.5 inches and weighing 14,000 pounds. As with deck module 30, deck module 244 may also be used to construct an elevated roadway by supporting deck module 244 with a concrete wall and foundation arrangement similar to wall 230 and foundation 231 in FIG. 6. Likewise, deck module 244 may be used to construct a ground-level roadway by supporting it directly from a foundation similar to foundation 238 in FIG. 7.

Since deck modules 30 and 244, spinal beams 32 and 256 and supporting columns 34 are all precast modular units, they may be prefabricated in sizes which are convenient for handling and subsequently shipped to the construction site for incorporation into the roadway. The modular construction of the aerial, elevated, and ground-level roadways permits faster construction, thereby affording shorter construction time and lower construction expense. The roadway modular units may be adapted to any particular dimensions from a wide range of selections with the use of adjustable forms as is well known in the art.

I claim:

1. In roadway apparatus for a transportation vehicle suitable for carrying passengers, the combination of;

a spinal beam having a channel formed between two side members;

a form sheet positioned over said channel of the spinal beam;

at least one deck module supported on said spinal beam by said side members, said one deck module including a cavity positioned over said form sheet, and;

means within said cavity to attached the deck module to said spinal beam.

2. The roadway apparatus of claim 1, including at least one continuous layer of porous paving material integral with said deck module to provide a surface for said vehicle.

3. The roadway apparatus of claim 1, including a plurality of deck modules supported in successive relationship along the spinal beam by said side members.

4. The roadway apparatus of claim 1, including a plurality of deck modules successively arranged along the spinal beam, with each deck module including a web supported by the spinal beam and two cantilever arms providing respective running surfaces for said vehicle.

5. The roadway apparatus of claim 1, including a plurality of deck modules supported on said spinal beam in successive relationship and interlocked with adjacent modules.

6. The roadway apparatus of claim 1, with said spinal beam being comprised of prestressed concrete and said deck module being comprised of reinforced concrete.

7. The roadway apparatus of claim 1, including a plurality of spinal beams which are post-tensioned to form a continuous support structure for distributing the forces exerted on a particular spinal beam.

8. The roadway apparatus of claim 1, including a plurality of deck modules successively supported along the spinal beam and including at least one continuous layer of porous paving material integral with said plurality of deck modules to provide a running surface for the vehicle.

9. In roadway apparatus for a transportation vehicle for carrying passengers and directed by guide wheels depending from said vehicle and engaging a guide member, the combination of;

a spinal beam having a channel formed between two side members;

a plurality of cantilevered deck modules successively supported along said spinal beam to provide a pair of running surfaces for the transportation vehicle, with each deck module having a web section for supporting the guide member between the pair of running surfaces and having a cavity within said web section, and;

means filled within each said cavity for attaching the deck module associated with that cavity to the spinal beam.

10. The roadway apparatus of claim 9, with each of the running surfaces being paved with a continuous layer of porous material.

* * * * *